US005908578A

United States Patent [19]

Nishimuro et al.

[11] Patent Number: 5,908,578

[45] Date of Patent: Jun. 1, 1999

[54] BONDED MAGNET-FORMING COMPOSITION AND MAGNET ROLLER USING THE SAME

[75] Inventors: Yoichi Nishimuro, Kunitachi; Muneori Iizuka, Kodaira; Kunio Machida, Tokyo; Hideharu Daifuku, Fujisawa, all of Japan

[73] Assignee: Bridgestone Corporation, Tokyo, Japan

[21] Appl. No.: 08/760,962

[22] Filed: Dec. 5, 1996

[30] Foreign Application Priority Data

| | | | |
|---|---|---|---|
| Dec. 7, 1995 | [JP] | Japan | 7-345248 |
| Dec. 7, 1995 | [JP] | Japan | 7-345249 |
| Dec. 11, 1995 | [JP] | Japan | 7-346074 |
| Dec. 11, 1995 | [JP] | Japan | 7-346075 |

[51] Int. Cl.[6] ..... H01F 7/02; G03G 15/06

[52] U.S. Cl. ..... 252/62.54

[58] Field of Search ..... 252/62.54

[56] References Cited

U.S. PATENT DOCUMENTS

| | | | |
|---|---|---|---|
| 3,477,961 | 11/1969 | Castagna | 252/62.54 |
| 4,689,269 | 8/1987 | Mukai et al. | 252/62.54 |

FOREIGN PATENT DOCUMENTS

| | | | |
|---|---|---|---|
| 63-6404 | 3/1988 | Japan | 252/62.54 |

*Primary Examiner*—Melissa Koslow

*Attorney, Agent, or Firm*—Sughrue, Mion, Zinn, Macpeak & Seas, PLLC

[57] ABSTRACT

A bonded magnet featuring mechanical strength is obtained from a bonded magnet-forming composition comprising magnetic powder and a binder wherein the binder is based on highly crystalline polypropylene in one form or contains a modified polyolefin in another form. Also provided is a magnet roller comprising a magnet body (1) of bonded magnet configured into a roller shape and a shaft (2) associated therewith wherein at least the magnet body (1) is formed from the bonded magnet-forming composition.

9 Claims, 2 Drawing Sheets

1
2e 1
2e 1
4a
2e 1
4a
2e 1
4b
2e 1
4b
2e

BONDED MAGNET-FORMING COMPOSITION AND MAGNET ROLLER USING THE SAME

BACKGROUND OF THE INVENTION

1. Field of the Invention

This invention relates to a bonded magnet-forming composition which can be compacted into a bonded magnet featuring mechanical strength and a magnet roller formed from the composition.

2. Prior Art

A jumping development system is well known in the field of electrophotographic machines such as copiers and printers and electrostatic recording machines. One typical developing roller for developing an electrostatic latent image on a latent image-bearing body typically in the form of a photoconductor drum into a visual image includes a rotating sleeve and a static magnet roller disposed therein and formed from a bonded magnet. The magnet roller has such magnetic properties such that a magnetic developing agent or toner borne on the sleeve surface may be forced to jump to the latent image-bearing body. Through this jumping development, the toner is supplied to the surface of the latent image-bearing body for visualizing the electrostatic latent image.

In general, the magnet roller is prepared from a bonded magnet-forming composition comprising a binder of thermoplastic resin such as nylon and polypropylene and magnetic powder such as ferrite. The bonded magnet-forming composition commonly available in pellet form is injection molded or extrusion molded in a mold across which a magnetic field is applied whereby the composition is shaped into a roller while magnetized to desired magnetic properties. The roller is generally provided with a shaft for supporting the roller. The shaft may take various forms, for example, an elongated shaft axially extending through the roller and a pair of shaft stubs projecting from the roller at axially opposite ends. The shaft stubs at axially opposite ends may be separate members or integral members formed integral with the roller body from a bonded magnet-forming composition. The shaft of the magnet roller is sometimes provided with a gear which is used to drive the roller for rotation. Where the shaft stubs are formed integral with the roller body from a bonded magnet-forming composition as mentioned just above, the gear may also be formed integral with the shaft stub and roller body from the bonded magnet-forming composition (see Japanese Utility Model Application Kokai No. 114809/1986).

Magnet rollers formed from prior art bonded magnet-forming compositions using general-purpose resins such as polypropylene as a binder, however, are not always sufficient in mechanical strength. For example, it is difficult to fill polypropylene with a large amount of ferrite for the following reasons. (1) Since molten polypropylene has a high viscosity, it is difficult to uniformly disperse ferrite therein upon kneading. (2) Since molten polypropylene has low strength, polypropylene with a high loading of ferrite is difficult to pelletize. When polypropylene with a high loading of ferrite is milled, extruded into strands and cut into pellets, strands are torn into pieces. Since high loading of polypropylene with ferrite is difficult for this and other reason, the filled polypropylene cannot have sufficient stiffness. Additionally, polypropylene is a nonpolar resin which cannot effectively wet ferrite. This is another reason why sufficient strength is not obtained.

Magnet rollers formed from prior art bonded magnet-forming compositions using general-purpose resins, typically polypropylene of general grade as a binder suffer from problems including low mechanical strength, difficulty to form reduced diameter rollers, and a limited range of application. Where a magnet roller is used as a developing roller and cleaning roller in electrophotographic equipment, for example, the bonded magnet-forming composition should have mechanical strength as represented by a flexural modulus of about 650 kgf/mm$^2$ and a flexural strength of about 4.5 kgf/mm$^2$. Such mechanical strength can be accomplished by few of prior art bonded magnet-forming compositions using general-purpose resins such as general grade polypropylene as a binder. Where the shaft is molded integral with the roller body from a bonded magnet-forming composition as previously mentioned, it is difficult to mold the shaft so as to have satisfactory strength and especially to mold an integral gear having satisfactory strength together with the shaft.

SUMMARY OF THE INVENTION

Therefore, an object of the invention is to provide a bonded magnet-forming composition which exhibits improved mechanical strength when molded into bonded magnet parts and is suitable to mold magnet rollers having a reduced diameter and magnet rollers having a shaft integrally molded therewith. Another object of the invention is to provide a magnet roller formed from the bonded magnet-forming composition and having improved mechanical strength.

We have found that by using highly crystalline polypropylene, especially having a crystallinity of 60 to 85% as a binder base in a bonded magnet-forming composition, molded parts of the bonded magnet-forming composition are significantly improved in mechanical strength, allowing the magnet roller to be reduced in diameter as compared with magnet rollers molded from conventional bonded magnet-forming compositions using general-purpose resins, typically polypropylene of the general grade as a binder. Specifically, the highly crystalline polypropylene has significantly high stereoregularity as compared with conventional polypropylene and molded parts thereof have far greater rigidity and surface hardness than conventional polypropylene. The use of such highly crystalline polypropylene results in bonded magnet parts being improved in mechanical strength including flexural modulus and flexural strength.

In a first aspect, the present invention provides a bonded magnet-forming composition comprising magnetic powder and a binder based on highly crystalline polypropylene; and a magnet roller comprising a body of bonded magnet configured into a roller shape and shaft means associated therewith, at least the magnet body being formed from the inventive bonded magnet-forming composition.

The inventors have also found that by using in a bonded magnet-forming composition a binder component containing a modified polyolefin obtained by introducing a reactive functional group (e.g., maleic anhydride, carboxyl, hydroxyl and glycidyl group) into the structure of polyolefin (e.g., polypropylene, polyethylene, and polyethylene copolymers), molded parts of the bonded magnet-forming composition are significantly improved in mechanical strength, allowing the magnet roller to be reduced in diameter as compared with magnet rollers molded from conventional bonded magnet-forming compositions using general-purpose resins, typically polypropylene of the general grade as a binder. Specifically, inclusion of the modified polyolefin in the binder component not only improves the contact between the binder and magnetic powder due to intermolecular forces of hydrogen bonds and secondary bonds generated between the modified polyolefin and the magnetic powder (e.g., ferrite) and filler, but also improves the dispersion of magnetic-powder and filler to promote uniform dispersion while suppressing secondary agglomeration of ferrite. The bond strength between the binder component and the magnetic powder and filler is thus improved to prevent strand tearing and enable high loading of magnetic powder. Molded parts are significantly improved in mechanical strength including flexural modulus and flexural strength.

In a second aspect, the present invention provides a bonded magnet-forming composition comprising magnetic powder and a binder containing a modified polyolefin; and a magnet roller comprising a body of bonded magnet configured into a roller shape and shaft means associated therewith, at least the magnet body being formed from the inventive bonded magnet-forming composition.

BRIEF DESCRIPTION OF THE DRAWINGS

These and further features of the present invention will be apparent with reference to the following description and drawings, wherein:

FIGS. 2-C and 2-D are fragmentary perspective and cross-sectional views of a magnet roller according to a further embodiment of the invention.

FIGS. 2-E and 2-F are fragmentary perspective and cross-sectional views of a magnet roller according to a still further embodiment of the invention.

DESCRIPTION OF THE PREFERRED EMBODIMENT

Figure 1A:
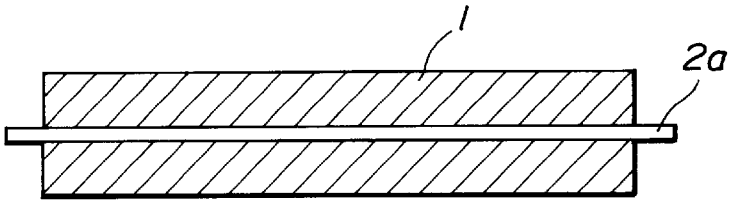
FIGS. 1-A to 1-D are schematic cross-sectional views of magnet rollers according to various embodiments of the invention.
Figure 1B:
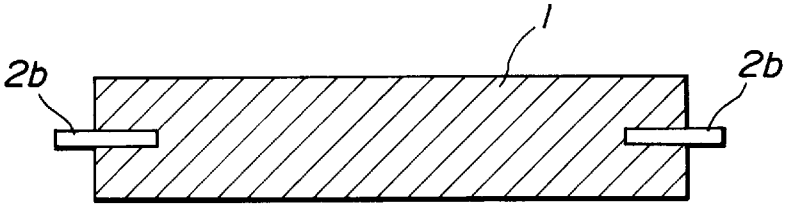
Figure 1C:
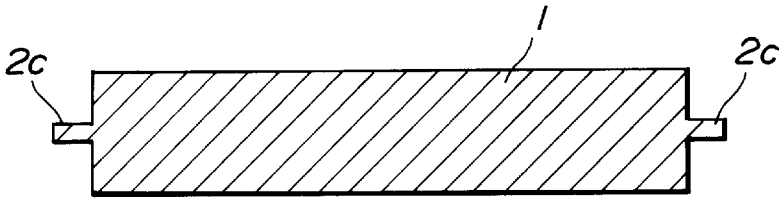
Figure 1D:
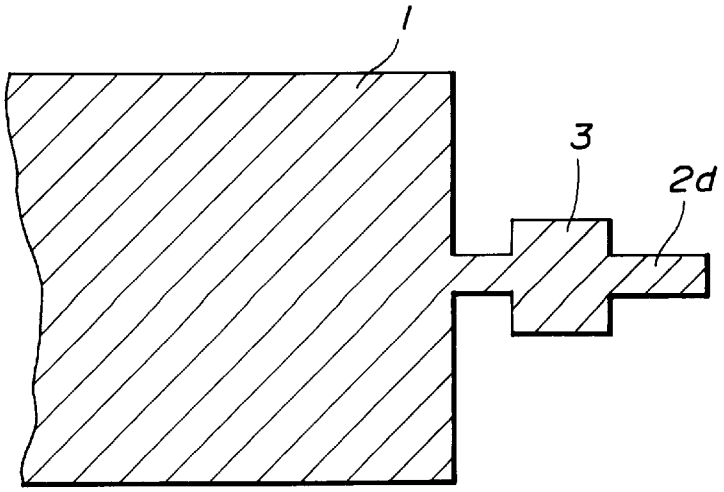

Briefly stated, the present invention provides a bonded magnet-forming composition comprising magnetic powder and a binder. The invention also provides a magnet roller comprising a magnet body of bonded magnet configured into a roller shape and shaft means associated therewith wherein at least the magnet body is formed from the bonded magnet-forming composition.

In the first aspect, the binder contains highly crystalline polypropylene as a base.

The highly crystalline polypropylene used herein is a polypropylene having significantly high stereoregularity and highly controlled crystallinity as compared with conventional polypropylenes. Molded parts of highly crystalline polypropylene are improved in rigidity, surface hardness, and deflection temperature under load over conventional polypropylenes. Polypropylene having a crystallinity of 60 to 85%, especially 65 to 80% is preferred. More preferably the highly crystalline polypropylene has a flexural modulus of at least 150 kgf/mm$^2$, especially at least 180 kgf/mm as measured on JIS K 7203. With a flexural modulus of less than 150 kgf/mm$^2$, the resulting bonded magnet would have low mechanical strength, failing to attain the objects of the invention.

The highly crystalline polypropylene is used as a binder of a bonded magnet-forming composition according to the invention. The binder may consist solely of highly crystalline polypropylene or be a mixture of highly crystalline polypropylene and another thermoplastic resin. The invention requires that highly crystalline polypropylene be a base or major component of the binder. The other thermoplastic resins which can be added to the highly crystalline polypropylene include polyamides such as nylon-6, nylon-12; epoxy resins; polyolefins such as polystyrene, polyethylene terephthalate (PET), polybutylene terephthalate (PBT), polyphenylene sulfide (PPS), ethylene-vinyl acetate copolymers (EVA), ethylene-ethyl acrylate copolymers (EEA), ethylene-vinyl alcohol copolymers (EVOH), conventional polypropylene (excluding highly crystalline one), polyethylene, and polyethylene copolymers; and modified polyolefins in the form of polyolefins having a reactive functional group such as a maleic anhydride, carboxyl, hydroxyl and glycidyl group introduced in the structure thereof. Preferred are the modified polyolefins, especially maleic anhydride-modified polypropylene. Blending such a modified polyolefin with highly crystalline polypropylene results in a bonded magnet-forming composition having improved mechanical strength, especially significantly improved flexural strength.

Although the amount of the other thermoplastic resin blended is not critical, it is generally about 1 to about 30% by weight of the binder. In the case of modified polyolefin, its amount is preferably limited to about 1 to about 10% by weight because of cost. In the bonded magnet-forming composition, the content of the binder based on highly crystalline polypropylene is not critical although it is preferably about 8 to about 40% by weight, especially about 10 to about 25% by weight of the entire bonded magnet-forming composition.

In the second aspect, the binder contains a modified polyolefin.

The modified polyolefin is a polyolefin having a reactive functional group introduced in its structure as mentioned above. Exemplary are polyolefins such as polypropylene, polyethylene and polyethylene copolymers having a reactive functional group such as a maleic anhydride, carboxyl, hydroxyl, glycidyl and ester group introduced in the structure thereof. Maleic anhydride-modified polyolefins, especially maleic anhydride-modified polypropylene are usually employed. More particularly, among various acid anhydrides, carboxylic acids, and esters used in modifying polyolefins, maleic anhydride is most easy and effective to modify polyolefins. In the practice of the invention, maleic anhydride-modified polypropylene is preferably used because of strength enhancement and availability.

The modified polyolefin is used as a binder of a bonded magnet-forming composition according to the invention. The binder may consist solely of a modified polyolefin, but is preferably a mixture of a modified polyolefin and another thermoplastic resin. The invention especially favors to use another thermoplastic resin as a base or major component and modified polyolefin as an additive. The other thermoplastic resins which can be used along with the modified polyolefin are those resins commonly used as a binder in bonded magnet-forming compositions. Examples include polyolefins such as nylon-6, polypropylene, polyethylene, polystyrene, polyethylene terephthalate (PET), polybutylene terephthalate (PBT), polyphenylene sulfide (PPS), ethylene-vinyl acetate copolymers (EVA), ethylene-ethyl acrylate copolymers (EEA), and ethylene-vinyl alcohol copolymers (EVOH) alone or in admixture of two or more. In the practice of the invention, highly crystalline polypropylene, more specifically polypropylene having a crystallinity of 60 to 85%, especially 65 to 80% is preferably used in combination with the modified polyolefin. As defined in the first aspect, the highly crystalline polypropylene used herein is a polypropylene having significantly high stereoregularity and highly controlled crystallinity as compared with conventional polypropylenes. Molded parts of highly crystalline polypropylene are improved in rigidity, surface hardness, and deflection temperature under load over conventional polypropylenes. The use of highly crystalline polypropylene in a bonded magnet-forming composition is thus effective for improving the mechanical strength of the composition.

Where the modified polyolefin is combined with another resin to construct the binder, the content of modified polyolefin is preferably about 1 to 30% by weight of the binder. A modified polyolefin content of about 1 to 10% by weight of the binder component is especially preferred for cost. In the bonded magnet-forming composition, the content of the binder containing modified polyolefin is not critical although it is preferably about 8 to about 40% by weight, especially about 10 to about 25% by weight of the entire bonded magnet-forming composition.

In both the first and second aspects, the bonded magnet-forming composition is obtained by mixing the above-defined binder with magnetic powder. The magnetic powder may be one commonly used in the preparation of bonded magnets, for example, ferrites such as barium ferrite and strontium ferrite and rare earth metal alloys such as Sm—Co system alloys and Nd—Fe—B system alloys.

The amount of magnetic powder blended is properly determined in accordance with the required magnetic force although it is preferably about 60 to 92% by weight, especially 75 to 90% by weight of the entire bonded magnet-forming composition.

In the bonded magnet-forming compositions according to the first and second aspects, there may be added fillers having a significant reinforcement function, for example, mica, whiskers, talc, carbon fibers, and glass fibers. Where a molded part is only required to have a relatively low magnetic force and hence, the loading of magnetic powder such as ferrite is relatively low, the molded part tends to have low rigidity. In such a case, to compensate for a lack of rigidity, fillers such as mica and whiskers are added for reinforcing the molded part. The filler used herein is preferably mica or whiskers. Exemplary whiskers are non-oxide whiskers such as whiskers of silicon carbide and silicon nitride; whiskers of metal oxides such as ZnO, MgO, $TiO_2$, $SnO_2$, and $Al_2O_3$; and double oxide whiskers such as whiskers of potassium titanate, aluminum borate, and basic magnesium sulfate. Among these, double oxide whiskers are especially preferred since they can be readily compounded with plastics.

Although the amount of the filler blended is not critical, it is generally about 2 to 32% by weight, especially about 5 to 20% by weight of the bonded magnet-forming composition excluding the magnetic powder.

On use of the bonded magnet-forming composition according to the first or second aspect of the invention, a bonded magnet is obtained by mixing the above-mentioned components, melt kneading them to form a composition, processing the composition into pellets, and injection molding or extrusion molding the composition into any desired shape. The respective steps may be carried out by conventional procedures. For example, melt kneading may be carried out in a conventional manner under conventional conditions using a twin screw mixing extruder or KCK mixing extruder. Also, injection molding and extrusion molding may be carried out in a conventional manner under conventional conditions.

The magnet roller according to the invention is obtained by molding the bonded magnet-forming composition according to the first or second aspect of the invention. The magnet roller is configured as comprising a roller-shaped magnet body and shaft means. Various embodiments of the magnet roller are shown in FIGS. 1-A to 1-D. The magnet roller shown in FIG. 1-A has a roller-shaped magnet body 1 molded from the bonded magnet-forming composition according to the invention and an elongated metallic shaft 2*a* axially extending through the body 1. That is, the shaft is the axially extending shaft 2*a*. The shaft need not extend through the magnet body. In the embodiment of FIG. 1-B, metallic shaft stubs 2*a* and 2*b* are embedded in the magnet body 1 at axially opposed ends and axially project therefrom. In the embodiment of FIG. 1-C, shaft stubs 2*c* at axially opposed ends of the magnet body 1 are molded integral with the magnet body 1 from the bonded magnet-forming composition according to the invention. It is acceptable to mold only one shaft stub integral with the body. The shaft 2*a* or shaft stub 2*b* or 2*c* may be provided with a driving gear for rotating the roller. Where a shaft stub 2*d* is molded integral with the magnet body 1 from the bonded magnet-forming composition, the driving gear 3 may also be molded integral with the shaft stub 2*d* as shown in FIG. 1-D.

Figures 2A, 2B, 2C, 2D, 2E, 2F:
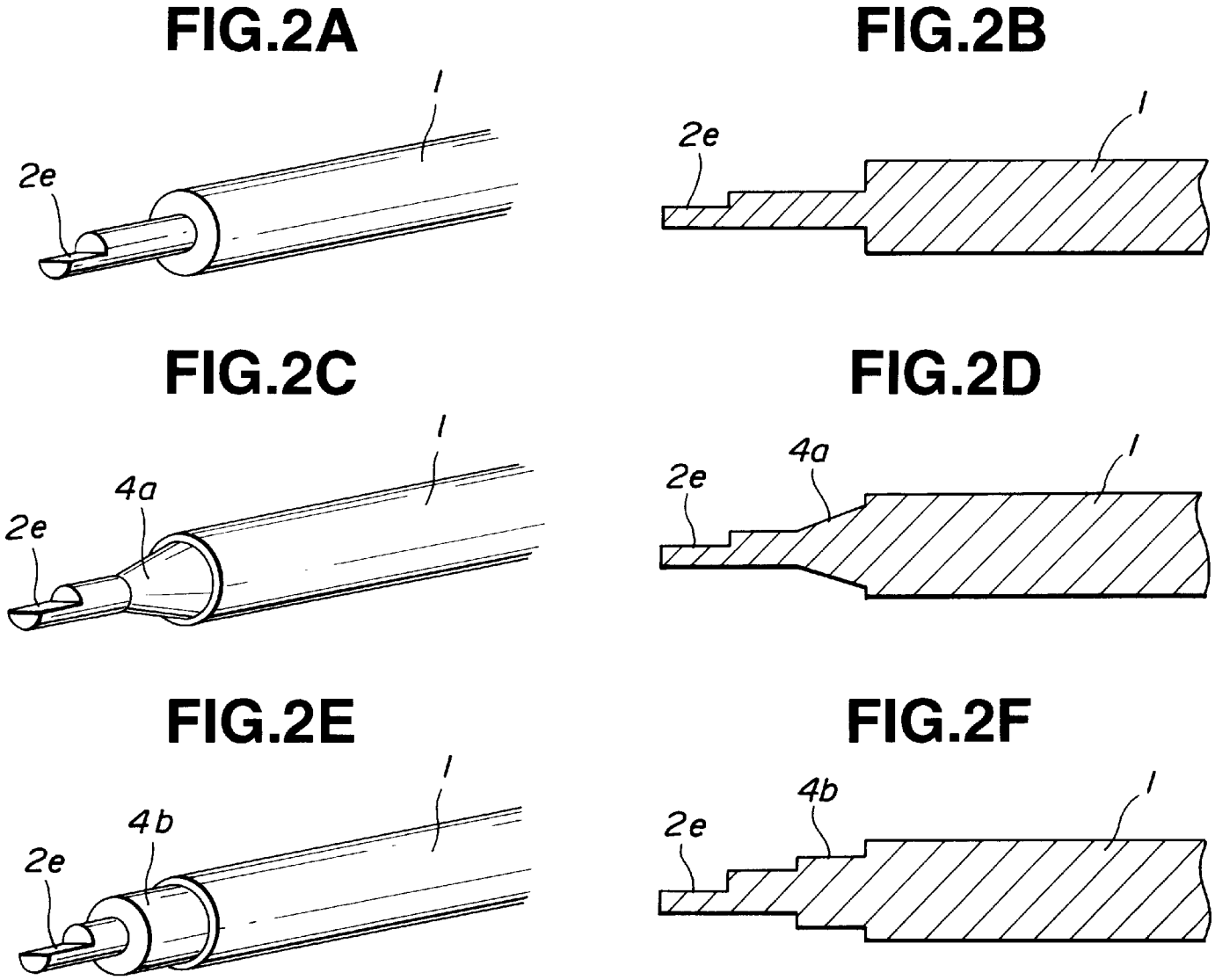
FIGS. 2-A and 2-B are fragmentary perspective and cross-sectional views of a magnet roller according to another embodiment of the invention.

As shown in FIGS. 2-A to 2-F, the shaft may be provided at an end with a notch 2*e* for coupling engagement with a counter member. In the illustrated example, the notch 2*e* is formed as a hemi-circular cutout. In FIGS. 2-A and 2-B, the cylindrical shaft portion is provided at an end with the notch 2*e*. In FIGS. 2-C and 2-D, the shaft portion provided with the notch 2*e* is connected to the magnet body 1 via a conical portion 4*a*. In FIGS. 2-E and 2-F, the shaft portion provided with the notch 2*e* is connected to the magnet body 1 via a large diameter transition 4*b*. The shaft portion having the notch 2*e* is formed integral with the magnet body 1 from the bonded magnet-forming composition as shown in FIGS. 2-B, 2-D and 2-F although it may be a separate member of metal or the like.

The magnet roller of the invention can be molded by conventional techniques using the bonded magnet-forming composition according to the first or second aspect of the invention. More particularly, the bonded magnet-forming composition in pellet form is injection or extrusion molded in a mold to form at least the magnet body 1 while a magnetic field is applied across the mold in a predetermined direction whereby the magnet body 1 is magnetized to have desired magnetic properties.

The magnet roller of the invention is advantageously used to construct a developing roller or cleaning roller in electrophotographic machines such as copiers and printers and electrostatic recording machines. After toner remaining on a latent image holder such as a photoconductor drum is scraped off by a cleaning blade, the cleaning roller is used to collect the scraped toner under the impetus of a magnetic force. The magnet roller is located at a position suitable for toner collection so that the magnet roller magnetically attracts toner. The toner is then scraped off the magnet roller by another blade and recovered in a suitable container.

The bonded magnet-forming composition according to the invention can be molded into bonded magnets having improved mechanical strength. The composition is advantageously applicable to molding of a slender magnet roller and molding of a magnet roller with an integral shaft. The magnet roller molded from the bonded magnet-forming composition according to the invention has improved mechanical strength so that it can have a reduced diameter in contrast to conventional compositions which are difficult to form slender rollers.

EXAMPLE

Examples of the invention are given below by way of illustration and not by way of limitation.

Examples 1–10

The components shown in Table 1 were melt kneaded in a kneader and extrusion molded into pellets. Bending test samples were prepared. The samples were measured for flexural strength (FS) and flexural modulus (FM). The results are shown in Table 1.

In Table 1, abbreviations for various components have the following meaning.

Gen PP: general grade polypropylene with crystallinity 55% (FM=140 kgf/mm$^2$, FS=3.2 kgf/mm$^2$)

Hi-c PP: highly crystalline polypropylene with crystallinity 70% (FM=210 kgf/mm$^2$, FS=4.4 kgf/mm$^2$)

Mod PO(1): maleic anhydride-modified polypropylene

Mod PO(2): maleic anhydride-modified polypropylene of high stiffness type

Mica: Suzorite mica by Kurare K. K.

Whisker: double oxide whiskers

GF: glass short fibers

Polyamide: nylon-6

The amount of component blended is expressed in % by weight. It is understood that a composition consisted of 81% by weight of ferrite and 19% by weight of a binder (base polypropylene+additional resin+modified polyolefin) and filler. Comparative Example (CE) used only general grade polypropylene as a binder.

TABLE 1

| | Bonded magnet-forming composition | | | | Mechanical strength | |
|---|---|---|---|---|---|---|
| | Base polypropylene | Polyolefin (remainder excluding ferrite is 100%) | Filler or resin | Ferrite | FS (kgf/mm$^2$) | FM (kgf/mm$^2$) |
| CE | Gen PP 100% | — | — | 81% | 4.10 | 560 |
| E1 | Hi-c PP 100% | — | — | 81% | 4.44 | 676 |
| E2 | Hi-c PP 95% | Mod PO(1) 5% | — | 81% | 6.35 | 708 |
| E3 | Hi-c PP 90% | Mod PO(1) 10% | — | 81% | 6.39 | 681 |
| E4 | Hi-c PP 90% | Mod PO(2) 10% | — | 81% | 6.60 | 785 |
| E5 | Hi-c PP 70% | Mod PO(1) 10% | Mica 20% | 81% | 6.31 | 986 |
| E6 | Hi-c PP 70% | Mod PO(1) 10% | Whisker 20% | 81% | 7.27 | 1009 |
| E7 | Hi-c PP 70% | Mod PO(1) 10% | GF 20% | 81% | 6.10 | 795 |
| E8 | Hi-c PP 60% | Mod PO(1) 10% | Polyamide 30% | 81% | 6.73 | 752 |
| E9 | Hi-c PP 50% | Mod PO(1) 10% | Gen PP 40% | 81% | 5.98 | 705 |
| E10 | Gen PP 95% | Mod PO(1) 5% | — | 81% | 5.10 | 697 |

Although some preferred embodiments have been described, many modifications and variations may be made thereto in the light of the above teachings. It is therefore to be understood that within the scope of the appended claims, the invention may be practiced otherwise than as specifically described.

We claim:

1. A bonded magnet-forming composition comprising magnetic powder and a binder based on highly crystalline polypropylene, wherein the highly crystalline polypropylene has a crystallinity of 60 to 85%.

2. The composition of claim 1 wherein the highly crystalline polypropylene has a flexural modulus of at least 150 kgf/mm$^2$.

3. The composition of claim 1 further comprising 2 to 32% by weight of mica and/or filler whiskers based on the weight of the composition excluding the magnetic powder.

4. A bonded magnet-forming composition comprising magnetic powder and a binder containing a modified polyolefin, further comprising 2 to 32% by weight of mica and/or filler whiskers based on the weight of the composition excluding the magnetic powder.

5. The composition of claim 4 wherein said binder comprises 1 to 30% by weight of the modified polyolefin and another thermoplastic resin.

6. The composition of claim 4 wherein the modified polyolefin is maleic anhydride-modified polypropylene.

7. The composition of claim 5 wherein the other thermoplastic resin is highly crystalline polypropylene.

8. A bonded magnet-forming composition comprising magnetic powder and a binder based on highly crystalline polypropylene, wherein said binder based on highly crystalline polypropylene further contains a modified polyolefin.

9. A bonded magnet-forming composition comprising magnetic powder and a binder containing a modified polyolefin, wherein said binder comprises 1 to 30% by weight of the modified polyolefin and another thermoplastic resin, and wherein the other thermo-plastic resin is highly crystalline polypropylene.

* * * * *